US006116948A

United States Patent [19]

Kunishi

[11] Patent Number: 6,116,948

[45] Date of Patent: Sep. 12, 2000

[54] ELECTRICAL CONNECTOR FOR TERMINATING DISCRETE ELECTRICAL WIRES

[75] Inventor: Shinsuke Kunishi, Hadano, Japan

[73] Assignee: Molex Incorporated, Lisle, Ill.

[21] Appl. No.: 09/232,949

[22] Filed: Jan. 19, 1999

[30] Foreign Application Priority Data

Jan. 30, 1998 [JP] Japan ..... 10-033820

[51] Int. Cl.[7] ..... H01R 12/24

[52] U.S. Cl. ..... 439/495

[58] Field of Search ..... 439/495, 496, 439/492, 67, 77

[56] References Cited

U.S. PATENT DOCUMENTS

| | | | |
|---|---|---|---|
| 4,713,020 | 12/1987 | Awano et al. | 439/267 |
| 5,415,220 | 5/1995 | Hanato et al. | 174/254 |
| 5,863,217 | 1/1999 | Li et al. | 439/495 |
| 5,934,932 | 8/1999 | Ito | 439/495 |

*Primary Examiner*—Khiem Nguyen
*Assistant Examiner*—Brian S. Webb
*Attorney, Agent, or Firm*—Stephen Z. Weiss

[57] ABSTRACT

An electrical connector is provided for terminating a plurality of discrete electrical wires. The wires are adhered to a backing plate. The connector includes a housing defining a receptacle for receiving the electrical wires and the backing member. A plurality of terminals are mounted on the housing for contacting the electrical wires. An actuator is engageable with the backing member to maintain the discrete electrical wires in contact with the terminals.

15 Claims, 3 Drawing Sheets

ELECTRICAL CONNECTOR FOR TERMINATING DISCRETE ELECTRICAL WIRES

FIELD OF THE INVENTION

This invention generally relates to the art of electrical connectors and, particularly, to an electrical connector for terminating a plurality of discrete electrical wires. The connector is illustrated in combination with a second connector whereby the connector assembly connects the wires to the circuits on a printed circuit board.

BACKGROUND OF THE INVENTION

With the ever-increasing miniaturization and density of electrical circuitry and corresponding electronic devices, it has become increasingly difficult to terminate small electrical wires, such as very fine insulated wires. The wires may be connected to the terminals of an electrical connector by such techniques as soldering, insulation displacement or the like. However, such techniques become extremely difficult, time consuming and labor intensive when the wires are extremely small or fine. In fact, insulation displacement techniques cannot even be used with extremely fine insulated wires because of the tendency to damage or even cut through the wires. Soldering such very fine wires requires elaborate and expensive equipment. It has been proposed to secure the wires to a preliminary wire maintenance member or backing member and to use this subassembly to facilitate terminating the very fine wires. However, even this approach has not proven effective in small electrical connectors.

The present invention is directed to solving these problems by providing a simple and effective electrical connector for providing adequate wire maintenance in terminating discrete electrical wires, such as very fine insulated wires.

SUMMARY OF THE INVENTION

An object, therefore, of the invention is to provide a new and improved electrical connector for terminating discrete electrical wires.

Another object of the invention is to provide a new and improved electrical connector assembly for connecting a plurality of discrete electrical wires to the circuits on a printed circuit board.

As disclosed herein, the electrical connector assembly includes a first connector adapted for mounting on the printed circuit board and including a plurality of first terminals for connection to the circuits on the board. A backing member is adhered to the discrete electrical wires to maintain the wires in a predetermined relative array. The invention contemplates a second connector for mating with the first connector and including a plurality of second terminals for contacting the first terminals of the first connector. The second connector includes a receptacle for receiving the electrical wires and the backing member, with the wires positioned in contact with the second terminals. An actuator of the second connector is engageable with the backing member to maintain the discrete electrical wires in contact with the second terminals.

In the illustrated embodiment, the electrical wires are insulated wires and have portions of the insulation removed to expose lengths of the conductors of the wires, such that the insulation of the wires is adhered to the backing member and the conductors of the wires are in contact with the second terminals. The electrical wires are in a generally parallel array, and the second terminals are spaced corresponding to the spacing of the wires.

The second terminals of the second connector have forward contact ends for contacting the first terminals of the first connector and rear ends at the receptacle for contacting the electrical wires. The rear end of each of the second terminals is bifurcated to define a pair of legs forming a mouth into which one of the electrical wires and the backing member are inserted. One of the legs of each second terminal is engageable with a respective one of the electrical wires.

The actuator includes a forward insertion portion for inserting into the mouths between the legs of the second terminals. The actuator also includes a flange having a plurality of recesses for embracing the electrical wires. As disclosed herein, the backing member is a plate-like member, with the actuator engageable with an edge thereof, and the recesses in the flange of the actuator are notches for embracing the electrical wires.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
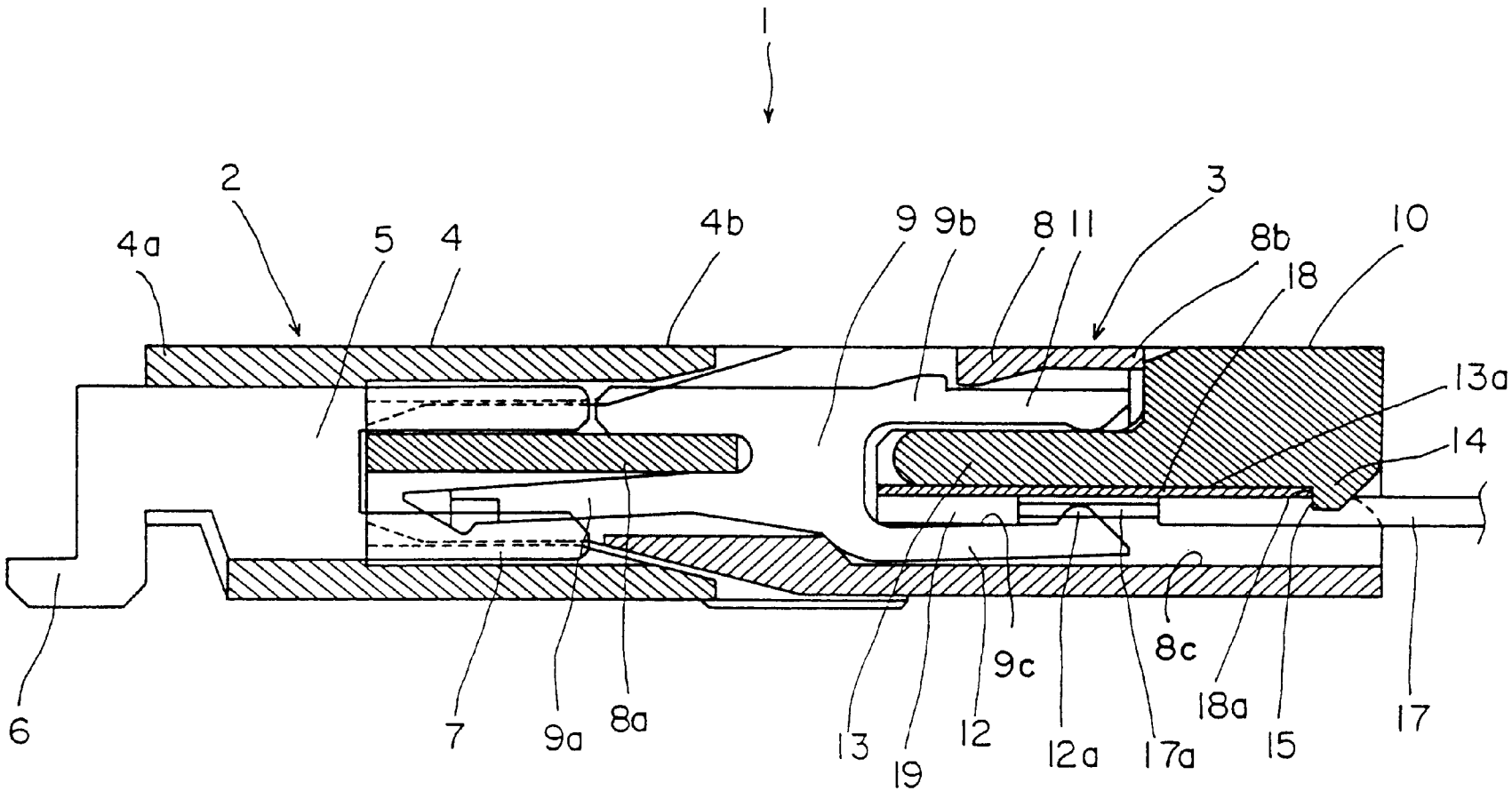
FIG. 1 is a vertical section through an electrical connector assembly embodying the concepts of the invention.

Referring to the drawings in greater detail, and first to FIG. 1, an electrical connector assembly, generally designated 1, is illustrated for connecting a plurality of discrete electrical wires to the circuits of a printed circuit board. Generally, connector assembly 1 includes a first connector, generally designated 2, adapted for mounting on the printed circuit board (not shown), and a second connector, generally designated 3, for mating with the first connector.

First connector 2 includes an insulating housing 4 mounting a plurality of first terminals 5 arranged at regular spaced intervals along the housing. The housing has a terminating end 4*a* and a mating end 4*b*. Each terminal 5 includes a solder tail 6 projecting from housing 4 for solder connection to a circuit on the printed circuit board. Each terminal includes a bifurcated contact end 7 disposed within housing 4.

Figure 2:
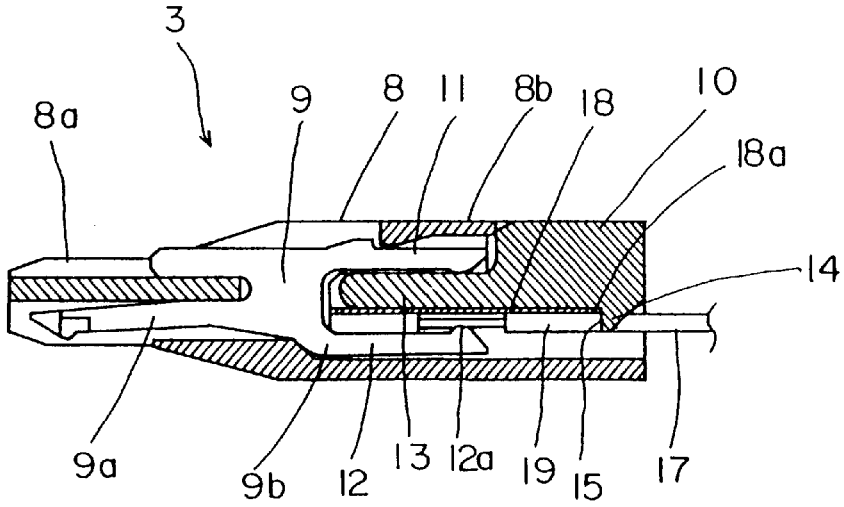
FIG. 2 is a vertical section through only the second connector of the connector assembly.
Figure 3:
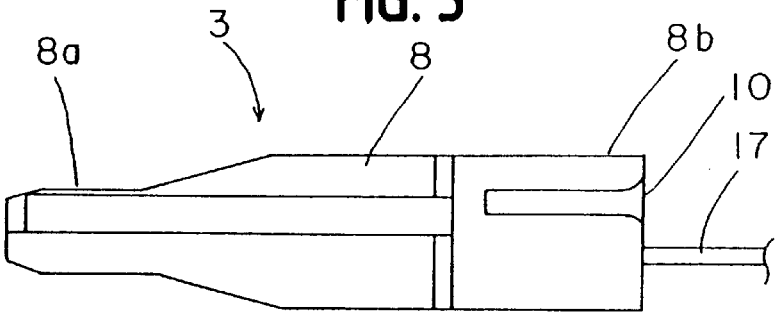
FIG. 3 is an end elevational view of the second connector.
Figure 4:
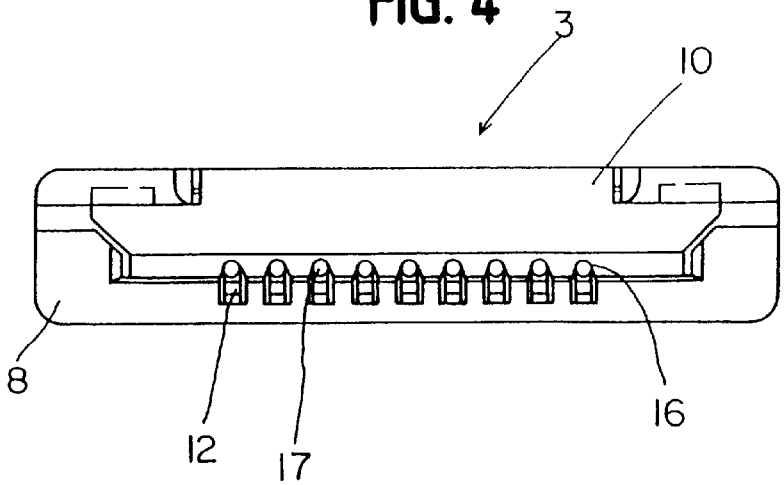
FIG. 4 is a rear elevational view of the second connector.

Referring to FIGS. 2–4 in conjunction with FIG. 1, second connector 3 includes an insulating housing 8 mounting a plurality of second terminals 9 arranged at regular spaced intervals along the housing, along with an actuator 10. Insulating housing 8 has a front insertion end or nose 8*a* for insertion into mating end 4*b* of housing 4 of first connector 2. Housing 8 has a rear end 8*b* defining a receptacle 8*c*. Terminals 9 extend between front insertion end 8*a* and rear end 8*b* of housing 8 of the second connector.

Each terminal 9 has a forward contact end 9*a* for contacting bifurcated contact end 7 of one of the first terminals 5 of first connector 2. Each second terminal 9 has a bifurcated rear end 9*b* defining a pair of legs 11 and 12 which form a mouth 9*c* therebetween. Each leg 12 has an upwardly projecting contact protrusion 12*a* at the rear end of the leg.

Actuator 10 of second connector 3 includes a forward insertion portion 13 for inserting into the mouths 9*c* between legs 11 and 12 of second terminals 9. The actuator has a bottom, generally planar surface 13*a* extending from a forward insertion portion back to an engagement flange 14 defining a forwardly facing abutment shoulder 15. When the forward insertion portion 13 of actuator 10 is inserted into mouths 9*c* between legs 11 and 12 of second terminals 9, the top legs 11 of the terminals act as pressure levers to sandwich the forward insertion portion of the actuator within the bifurcated rear ends of the terminals. Finally, as best seen in FIG. 4, engagement flange 14 is provided with a plurality of semicircular recesses or notches 16 which are precisely aligned with bottom legs 12 and contact protrusions 12*a* of properly spaced second terminals 9.

Figure 5:
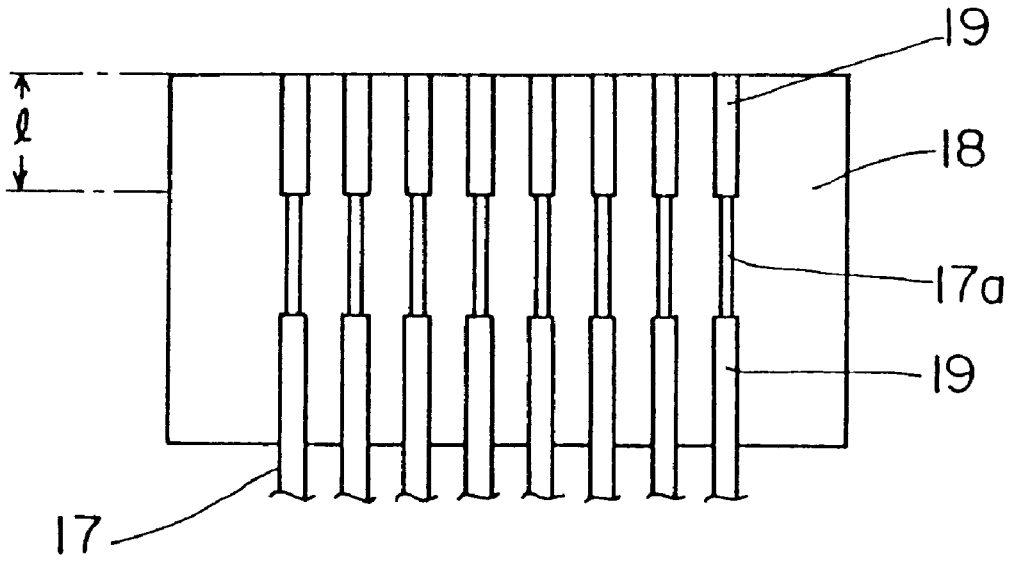
FIG. 5 is a plan view of a plurality of the parallel discrete electrical wires adhered to the backing plate.
Figure 6:
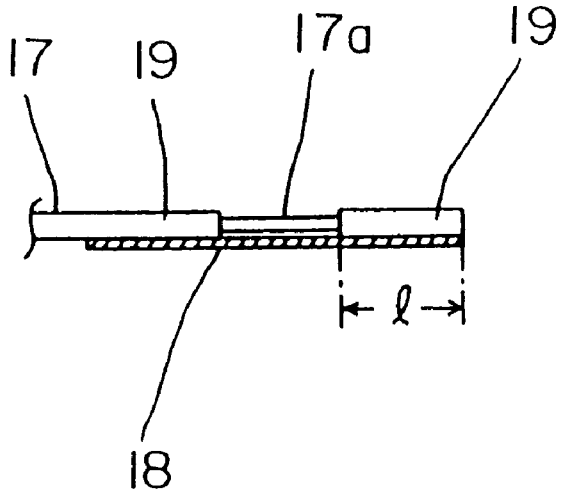
FIG. 6 is a side elevational view looking toward the right-hand side of FIG. 5.

FIGS. 5 and 6 show a plurality of discrete insulated electrical wires 17 in a generally parallel array, with the insulation 19 of each wire stripped to expose very fine conductors 17*a* of the wires. A given length "1" of the insulation remains on conductors 17*a* at forward ends of wires 17. A backing member in the form of a planar member or backing plate 18 is adhered to electrical wires 17, particularly to insulation 19 of the wires on opposite sides of conductors 17*a*. The backing plate may be fabricated of plastic material. In essence, the backing plate maintains wires 17 in their generally parallel array and at a spacing corresponding to bottom legs 12 and contact protrusions 12*a* of second terminals 9 of second connector 4.

In terminating the discrete electrical wires 17 within second connector 3, the subassembly of the wires and backing plate 18 are inserted into mouths 9*c* formed by bifurcated rear ends 9*b* of second terminals 9 as shown best in FIGS. 1 and 2. When this subassembly is so inserted, exposed conductors 17*a* of the wires are aligned with contact protrusions 12*a* of the second terminals. Forward insertion portion 13 of actuator 10 then is inserted into the bifurcated rear ends of the second terminals until abutment shoulder 15 at the front of engagement flange 14 of the actuator engages rear edge 18*a* of backing plate 18. Not only does the actuator maintain the backing plate and the adhered electrical wires properly within second connector 3, but the recesses or notches 16 in the bottom of engagement flange 14 embrace the electrical wires and maintain proper relative spacing of the wires, as seen in FIG. 4. In an alternative concept, the bottom of backing plate 18 can be adhered to the electrical wires and the top of the backing plate can be adhered to bottom surface 13*a* of actuator 10, whereby the entire subassembly of the actuator, the backing plate and the discrete insulated wires can be inserted simultaneously into the rear end of the second connector and into the bifurcated rear ends 9*b* of the second terminals.

It will be understood that the invention may be embodied in other specific forms without departing from the spirit or central characteristics thereof. The present examples and embodiments, therefore, are to be considered in all respects as illustrative and not restrictive, and the invention is t to be limited to the details given herein.

I claim:

1. An electrical connector assembly for connecting a plurality of discrete electrical wires to the circuits on a printed circuit board, comprising:

a first connector adapted for mounting on the printed circuit board and including a plurality of first terminals for connection to the circuits on the board;

a backing member adhered to the discrete electrical wires to maintain the wires in a predetermined relative array; and a second connector for mating with the first connector and including a plurality of second terminals for contacting the first terminals of the first connector, a receptacle for receiving the electrical wires and the backing member with the wires positioned in contact with the second terminals, and an actuator engageable with said backing member to maintain the discrete electrical wires in contact with the seconds terminals.

2. The electrical connector assembly of claim 1 wherein said electrical wires are insulated wires having portions of the insulation removed to expose lengths of the conductors of the wires, such that the insulation of the wires is adhered to the backing member and the conductors of the wires are in contact with the second terminals.

3. The electrical connector assembly of claim 1 wherein said electrical wires are in a generally parallel array, and the second terminals are spaced corresponding to the spacing of the wires.

4. The electrical connector assembly of claim 1 wherein said second terminals have forward contact ends for contacting the first terminals of the first connector and rear ends at said receptacle for contacting the electrical wires.

5. The electrical connector assembly of claim 4 wherein the rear end of each of the second terminals is bifurcated to define a pair of legs forming a mouth into which one of the electrical wires and the backing member are inserted.

6. The electrical connector assembly of claim 5 wherein one of the legs of each second terminal is engageable with a respective one of the electrical wires.

7. The electrical connector assembly of claim 5 wherein said actuator includes a forward insertion portion for inserting into the mouths between the legs of the second terminals.

8. The electrical connector assembly of claim 1 wherein said actuator includes a flange having a plurality of recesses for embracing the electrical wires.

9. The electrical connector assembly of claim 1 wherein said backing member is a plate-like member with the actuator engageable with an edge thereof.

10. The electrical connector assembly of claim 9 wherein said actuator has a flange engageable with the edge of the backing member, the flange having a plurality of notches for embracing the electrical wires.

11. An electrical connector assembly for connecting a plurality of discrete insulated electrical wires to the circuits on a printed circuit board, the insulated wires having portions of the insulation removed to expose lengths of the conductors of the wires, comprising:

a first connector adapted for mounting on the printed circuit board and including a plurality of first terminals for connection to the circuits on the board;

a backing member adhered to the insulation of the discrete electrical wires to maintain the wires in a generally spaced array; and a second connector for mating with the first connector and including a plurality of second terminals for contacting the first terminals of the first connector, a receptacle for receiving the electrical wires and the backing member, each second terminal having a forward end for contacting one of the first terminals of the first connector and a rear end at said receptacle for contacting the conductor of one of the electrical wires, the rear end of each of the second terminals being bifurcated to define a pair of legs forming a mouth into which one of the electrical wires and the backing member are inserted, one of the legs of each second terminal being engageable with a respective one of the electrical wires, and an actuator including a forward insertion portion for inserting into the mouths between the legs of the second terminals and engageable with the backing member to maintain the electrical wires in contact with the seconds terminals, the actuator including a flange engageable with an edge of the backing member, and the flange having a plurality of notches for embracing the electrical wires.

12. An electrical connector for terminating a plurality of discrete electrical wires adhered to backing member, comprising:

a housing defining a receptacle for receiving the electrical wires and the backing member;

a plurality of terminals mounted on the housing along the receptacle for contacting the electrical wires; and an actuator mountable on the housing and engageable with the backing member to maintain the discrete electrical wires in contact with the terminals and having a flange engageable with an edge of the backing member, the flange having a plurality of notches for embracing the electrical wires.

13. The electrical connector assembly of claim 12 wherein a rear end of each of the terminals is bifurcated to define a pair of legs forming a mouth into which one of the electrical wires and the backing member are inserted.

14. The electrical connector assembly of claim 13 wherein one of the legs of each terminal is engageable with a respective one of the electrical wires.

15. The electrical connector assembly of claim 13 wherein said actuator includes a forward insertion portion for inserting into the mouths between the legs of the terminals.

* * * * *